US005558729A

United States Patent [19]

Kim et al.

[11] Patent Number: 5,558,729

[45] Date of Patent: Sep. 24, 1996

[54] METHOD TO PRODUCE GAMMA TITANIUM ALUMINIDE ARTICLES HAVING IMPROVED PROPERTIES

[75] Inventors: Young-Won Kim, Dayton; Dennis M. Dimiduk, Beavercreek, both of Ohio

[73] Assignee: The United States of America as represented by the Secretary of the Air Force, Washington, D.C.

[21] Appl. No.: 379,860

[22] Filed: Jan. 27, 1995

[51] Int. Cl.[6] ..... C22F 1/18

[52] U.S. Cl. ..... 148/671; 148/670

[58] Field of Search ..... 148/670, 671

[56] References Cited

U.S. PATENT DOCUMENTS

| | | | |
|---|---|---|---|
| 5,185,045 | 2/1993 | Peters et al. | 148/671 |
| 5,226,985 | 7/1993 | Kim et al. | 148/671 |
| 5,417,781 | 5/1995 | McQuay et al. | 148/671 |

OTHER PUBLICATIONS

Y-W Kim and D. M. Dimiduk, "Deformation and Fracture Behavior of Gamma Titanium Aluminides", pp. 373–382 in *Aspects Of High Temperature Deformation And Fracture In Crystalline Materials,* edited by Y. Hosoi, H. Yoshinaga, H. Oikawa and K. Maruyama, The Japan Institute of Metals, Sendai, Japan, 1993.

*Primary Examiner*—John Sheehan

*Attorney, Agent, or Firm*—Charles E. Bricker; Thomas L. Kundert

[57] ABSTRACT

Gamma titanium aluminide alloys having the composition Ti—(45.5–47.5)Al—(0–3.0)X—(1–5)Y—(0.05–1.0)W, where X is Cr, Mn or any combination thereof, and Y is Nb, Ta or any combination thereof (at %), are treated to provide specific microstructures. To obtain duplex microstructures, the annealing temperature ($T_a$) range is the eutectoid temperature ($T_e$)+100° C. to the alpha transus temperature ($T_\alpha$)–30° C.; to obtain nearly lamellar microstructures, the annealing temperature range is $T_\alpha$–20° C. to $T_\alpha$–1° C.; to obtain fully lamellar microstructures, the annealing temperature range is $T_\alpha$ to $T_\alpha$+50° C. The times required for producing these microstructures range from 0.25 to 15 hours, depending on the desired microstructure, alloy composition, annealing temperature selected, material section size and grain size desired. The cooling schemes and rates after annealing depend mainly on the microstructure type and stability; for duplex and nearly lamellar microstructures, the initial cooling rate is 5° to 1000° C./min, while for fully lamellar microstructure, the initial cooling rate is 5° to 100° C./min. The article can be cooled at the initial rate directly to the aging temperature; alternatively, the article can be cooled at the initial rate down to a temperature between room temperature and the annealing temperature, then cooled to room temperature at a cooling rate between the initial rate and water quenching, after which the article is aged. Following annealing, the article is aged at a temperature in the range of 700° C. to 1050° C. for about 4 to 150 hours.

3 Claims, 2 Drawing Sheets

METHOD TO PRODUCE GAMMA TITANIUM ALUMINIDE ARTICLES HAVING IMPROVED PROPERTIES

RIGHTS OF THE GOVERNMENT

The invention described herein may be manufactured and used by or for the Government of the United States for all governmental purposes without the payment of any royalty.

BACKGROUND OF THE INVENTION

The present invention relates to titanium alloys usable at high temperatures, particularly those of the TiAl gamma phase type.

Titanium alloys have found wide use in gas turbines in recent years because of their combination of high strength and low density, but generally, their use has been limited to below 600° C., due to inadequate strength and oxidation properties. At higher temperatures, relatively dense iron, nickel, and cobalt base superalloys have been used. However, lightweight alloys are still most desirable, as they inherently reduce stresses when used in rotating components.

Considerable work has been performed since the 1950's on lightweight titanium alloys for higher temperature use. To be useful at higher temperature, titanium alloys need the proper combination of properties. In this combination are properties such as high ductility, tensile strength, fracture toughness, elastic modulus, resistance to creep, fatigue and oxidation, and low density. Unless the material has the proper combination, it will not perform satisfactorily, and thereby be of limited use. Furthermore, the alloys must be metallurgically stable in use and be amenable to fabrication, as by casting and forging. Basically, useful high temperature titanium alloys must at least outperform those metals they are to replace in some respect, and equal them in all other respects. This criterion imposes many restraints and alloy improvements of the prior art once thought to be useful are, on closer examination, found not to be so. Typical nickel base alloys which might be replaced by a titanium alloy are INCO 718 or IN 100.

Heretofore, a favored combination of elements with potential for higher temperature use has been titanium with aluminum, in particular alloys derived from the intermetallic compounds or ordered alloys $Ti_3Al$ (alpha-2) and TiAl (gamma). Laboratory work in the 1950's indicated these titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys.

Those skilled in the art recognize that there is a substantial difference between the two ordered titanium-aluminum intermetallic compounds. Alloying and transformational behavior of $Ti_3Al$ resemble those of titanium as they have very similar hexagonal crystal structures. However, the compound TiAl has a face-centered tetragonal arrangement of atoms and thus rather different alloying characteristics. Such a distinction is often not recognized in the earlier literature. Therefore, the discussion hereafter is largely restricted to that pertinent to the invention, which is within the TiAl gamma phase realm, i.e., about 50Ti-50Al atomically and about 65Ti-35Al by weight.

Room temperature tensile ductility as high as 4% has been achieved in two-phase gamma alloys based on Ti-48Al such as Ti-48Al—(1–3)X, where X is Cr, V or Mn. This improved ductility was possible when the material was processed to have a duplex microstructure consisting of small equiaxed gamma grains and lamellar colonies/grains. Under this microstructural condition, however, other important properties including low temperature fracture toughness and elevated temperature, i.e., greater than 700° C., creep resistance are unacceptably low. Research has revealed that an all-lamellar structure dramatically improves toughness and creep resistance. Unfortunately, however, these improvements are accompanied by substantial reductions in ductility and strength. Recent experiments have shown that the improved fracture toughness and creep resistance are directly related to the features of lamellar structure, but that the large gamma grain size characteristic of fully-lamellar gamma alloys is responsible for the lowered tensile properties. These experiments have also demonstrated that the normally large grain size in fully-lamellar microstructure can be refined.

Kim et at, U.S. Pat. No. 5,226,985, issued Jul. 13, 1993, describe two methods for refining the microstructure of lamellar gamma titanium aluminide alloys. The first method is referred to as a thermomechanical process (TMP) and comprises shaping the article by extrusion or hot die forging, rolling or swaging, followed by a stabilization aging treatment. Where shaping is by extrusion, extrusion is carried out at a temperature in the approximate range of 0° to 20° C. below the alpha-transus temperature of the alloy. The alpha-transus temperature ($T_\alpha$) generally ranges from about 1300° to about 1400° C., depending on the alloy composition. $T_\alpha$decreases with decreasing Al. The transus temperature has also been shown to decrease with many interstitial (e.g., O and C) and substitutional (e.g., Cr, Mn, Ta and W) alloying elements. $T_\alpha$ can be determined relatively routinely by standard isothermal heat treatments and metallography, or by Differential Thermal Analysis (DTA), provided the material is homogeneous.

The aging temperature can range between 750° and 1100° C., depending on the specific use temperature contemplated, for at least one hour and up to 300 hours. Where shaping is by hot die forging, rolling or swaging, such shaping is carried out at a temperature in the approximate range of 50° C. above $T_\epsilon$, the eutectoid temperature of two-phase gamma alloys (≈1130° C.), to about 0° to 20° C. below $T_\alpha$, at a reduction of at least 50% and a rate of about 5–20 mm/min. The TMP method provides a product with a fine lamellar microstructure.

The second method is referred to as a thermomechanical treatment (TMT), which comprises hot working at temperatures well below the alpha-transus ($T_\alpha$) with subsequent heat treatment near the alpha-transus followed by a stabilization aging treatment. Where shaping is by extrusion, extrusion is carried out at a temperature in the approximate range of $T_\epsilon$–130° C. to $T_\alpha$–20° C. Where shaping is by hot die forging, rolling or swaging, such shaping is carried out at a temperature in the approximate range of $T_\epsilon$–130° C. to $T_\alpha$–20° C., at a reduction of at least 50% and a rate of about 5–20 mm/min. Where shaping is by isothermal forging, such shaping is carried out at a temperature in the approximate range of $T_\epsilon$–130° C. to $T_\epsilon$+100° C., at a reduction of at least 60% and a rate of about 2–7 mm/min. After hot working, the article is heat treated at a temperature in the approximate range of $T_\alpha$–5° C. to $T_\alpha$+20° C. for about 15 to 120 minutes.

Following such heat treatment, the article is cooled and given an aging treatment. The TMT method provides a product having a fine, randomly oriented lamellar microstructure.

McQuay et al, Application Ser. No. 08/261,312, filed Jun. 14, 1994, disclose that the processing window can be extended, thus allowing for more realistic and reliable foundry practice. McQuay et al disclose four methods: The first of these methods comprises the steps of: (a) heat treating an alloy billet or preform at a temperature in the approximate range of $T_\alpha$ to $T_\alpha$+100° C. for about 0.5 to 8 hours, (b) Shaping the billet at a temperature between $T_\alpha$−30° C. and $T_\alpha$ to produce a shaped article, and (c) aging the thus-shaped article at a temperature between about 750° and 1050° C. for about 2 to 24 hours. The second method comprises (a) rapidly preheating an alloy preform to a temperature in the approximate range of $T_\alpha$ to $T_\alpha$+100° C., (b) shaping the billet at a temperature between $T_\alpha$ and $T_\alpha$+100° C. to produce a shaped article, and (c) aging the thus-shaped article at a temperature between about 750° and 1050° C. for about 2 to 24 hours. The preform is held at the preheat temperature for 0.1 to 2 hours, just long enough to bring the preform uniformly to the shaping temperature. The third method comprises the steps of: (a) heat treating an alloy billet or preform at a temperature in the approximate range of $T_\alpha$ to $T_\alpha$+100° C. for about 0.5 to 8 hours, (b) rapidly heating the preform to shaping temperature, if the shaping temperature is greater than the heat treatment temperature, (c) shaping the preform at a temperature between $T_\alpha$ and $T_\alpha$+100° C. to produce a shaped article, and (d) aging the thus-shaped article at a temperature between about 750° and 1050° C. for about 2 to 24 hours. The fourth method comprises the steps of: (a) heat treating an alloy billet or preform at a temperature in the approximate range of $T_\alpha$−40° C. to $T_\alpha$ for about 0.1 to 2 hours, (b) rapidly preheating the preform to shaping temperature, (c) shaping the preform at a temperature between $T_\alpha$ and $T_\alpha$+100° C. to produce an shaped article, and (d) aging the thus-shaped article at a temperature between about 750° and 1050° C. for about 2 to 24 hours.

These methods generate unique lamellar microstructures consisting of randomly oriented lamellar colonies, with serrated grain boundaries. Gamma titanium aluminide alloys with such structure have the requisite balance of properties for moderate and high temperature aerospace applications: high specific strength, stiffness, fracture resistance and creep resistance in the temperature range of room temperature to about 950° C.

We have now found that fully-lamellar microstructures can be refined with the retention of the regularity of lamellar structures in gamma titanium aluminide alloys modified with small mounts of tungsten (W). We have found that three different microstructures can be produced: fine duplex, modified nearly-lamellar and refined fully-lamellar.

Accordingly, it is an object of the present invention to provide improved methods for producing articles of gamma titanium aluminide alloys.

Other objects and advantages of the invention will be apparent to those skilled in the art.

SUMMARY OF THE INVENTION

In accordance with the invention, there are provided improved methods for producing articles of gamma titanium aluminide alloy having improved properties. These methods comprise post-hot work annealing treatments which provide specific microstructures.

The methods of this invention comprise hot working of alloy ingots or consolidated powder billets with subsequent annealing treatments at specific temperature ranges characteristic of each microstructure, followed by specific cooling schemes and then stabilization aging treatments. Hot working can be conducted at temperatures ranging from about 700° C. to $T_\alpha$+20° C.

The titanium-aluminum alloys suitable for use in the present invention are those alloys containing about 40 to 50 atomic percent Al (about 27 to 36 wt %), balance Ti. The methods of this invention are applicable to the entire composition range of two-phase gamma alloys which can be formulated as multi-component alloys: Ti—(45.5–47.5)Al—(0–3.0)X—(1–5)Y—(0.05–1.0)W, where X is Cr, Mn or any combination thereof, and Y is Nb, Ta or any combination thereof (at %); The presently preferred composition is Ti—(46–47)Al—(1.5–3.0)Cr—(2–3.5)Nb—(0.1–0.3)W (at %). The $T_\alpha$ of these alloys ranges from 1270° to 1360° C., depending on the alloy composition and can be quite accurately determined by differential thermal analysis (DTA) and metallographic examinations.

The key step for obtaining a desired type of microstructure is the post-hot work annealing treatment. To obtain duplex microstructures, the annealing temperature ($T_a$) range is $T_e$+100° C. to $T_\alpha$−30° C.; to obtain nearly lamellar microstructures, the annealing temperature range is $T_\alpha$−20° C. to $T_\alpha$−1° C.; to obtain fully lamellar microstructures, the annealing temperature range is $T_\alpha$ to $T_\alpha$+50° C. The times required for producing these microstructures range from 0.25 to 15 hours, depending on the desired microstructure, alloy composition, annealing temperature selected, material section size and grain size desired. The cooling schemes and rates after annealing depend mainly on the microstructure type and stability; two cooling scheme are presented hereinafter for each microstructure type. Following annealing, the article is aged at a temperature in the range of 700° C. to 1050° C. for about 4 to 150 hours.

DETAILED DESCRIPTION OF THE INVENTION

The starting materials are hot worked alloy ingots or consolidated powder billets, preferably in the hot isostatically pressed (HIP'd) condition. Working includes isothermal forging, extrusion or the like, including combinations thereof. In these processes, it is preferable that the billets be protected by a sacrificial can, as is employed in hot die extrusion. Where extrusion is employed, the parameters suitable for producing the desired microstructure include extrusion ratios between 4:1 and 30:1, and extrusion rates between 0.5 and 3.0 cm/sec. Isothermal forging rates of 1 to 10 mm/min and hot die forging rates of 5 to 30 mm/sec are suitable.

Figure 1:
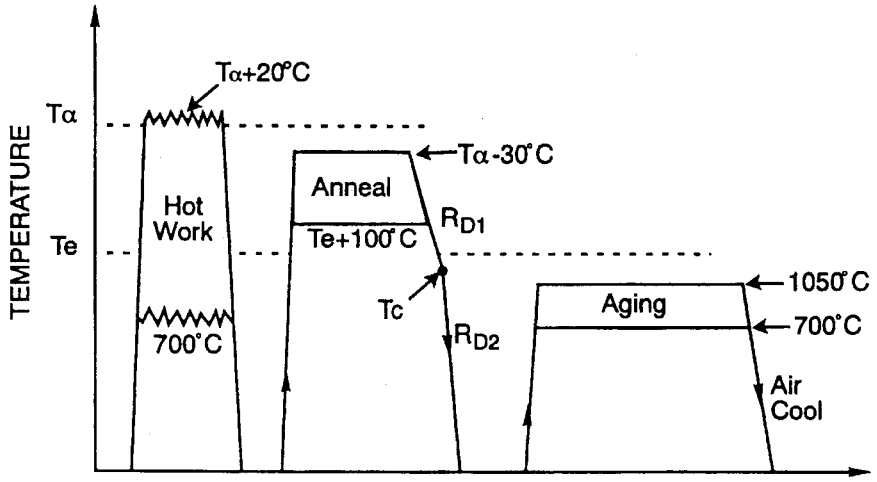
FIGS. 1 and 2 are schematic illustrations of methods for obtaining duplex microstructure.
Figure 2:
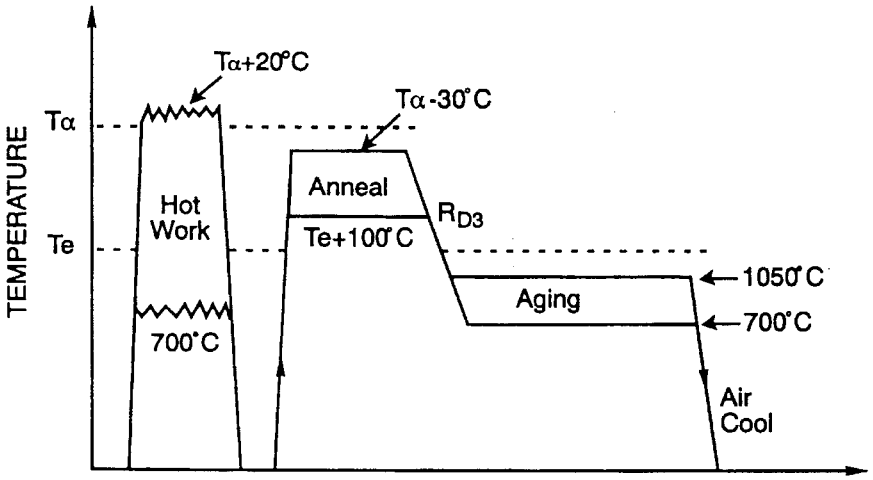

The processing for producing duplex microstructures consists of hot working, annealing and either indirect aging, as shown in FIG. 1, or direct aging, as shown in FIG. 2. Post-hot work annealing is conducted at a temperature in the rage of $T_e$+100° C. to $T_\alpha$30° C. for about 1 to 15 hours, depending on alloy composition, material section size, annealing temperature, desired distribution of microstructural constituents and grain mophology and size. Cooling rates and methods are critical for desired microstructures and the resulting mechanical properties. As shown in FIG. 1, two cooling rates $R_{D1}$ and $R_{D2}$ are employed. Rate $R_{D1}$ is used for the initial cooling from the annealing temperature ($T_a$) down to a preselected temperature, $T_c$, which is the temperature at which the cooling rate is increased so that coarsening of the second phase(s) is reduced or suppressed, and rate $R_{D2}$ is used for final cooling from $T_c$ down to room temperature. $T_c$ is in the range of about $T_a$ down to about 700° C. The initial cooling rate, $R_{D1}$ ranges from 5° to 1000° C./min, which includes air cooling (AC). Cooling rate $R_{D2}$ ranges from $R_{D1}$ to water quenching (WQ), including oil quenching (OQ). Cooling rates faster than air cooling (AC) can be used only when the article is not cracked during cooling. The article is then given an aging treatment at a temperature in the range of 700° to 1050° C. for about 2 to 150 hours, depending on the final microstructure, desired mechanical properties and desired microstructural stability, followed by air cooling.

Referring now to FIG. 2, scheme II duplex processing employs an annealing treatment followed by cooling at rate $R_{D3}$ directly to the aging temperature (700° C. to 1050° C.). Cooling rate $R_3$ is the same as rate $R_{D1}$, ranging from 5° to 1000° C./min, which can be achieved either by controlled cooling in the furnace or by transferring the article to another furnace or a salt bath at aging temperature.

The resulting microstructures consist of three phases: gamma grains, beta phase grains/particles and alpha-2 plates and particles. The gamma grain sizes range from 5 to 30 μm, depending on annealing temperature and time. The beta phase, of either plate or particle forms, ranges in size from 1 to 10 μm. The alpha-2 particles range in size from 0.5 to 5 μm.

Figure 3:
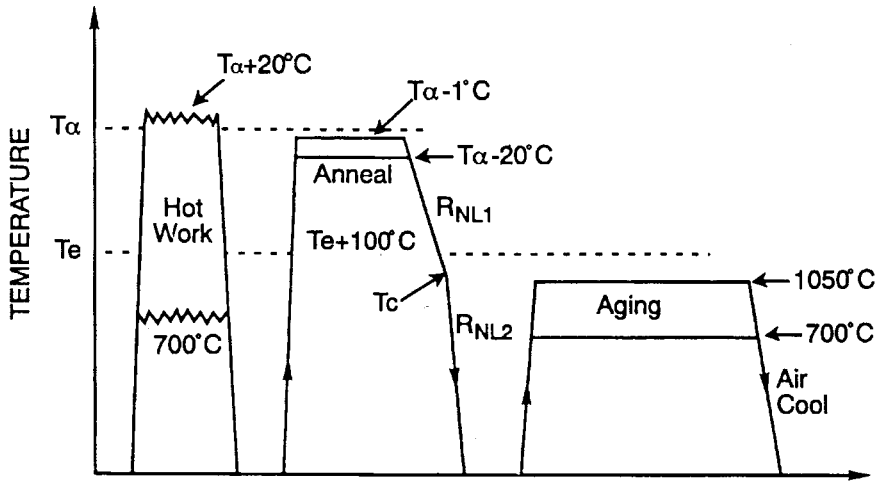
FIGS. 3 and 4 are schematic illustrations of methods for obtaining nearly lamellar microstructure.
Figure 4:
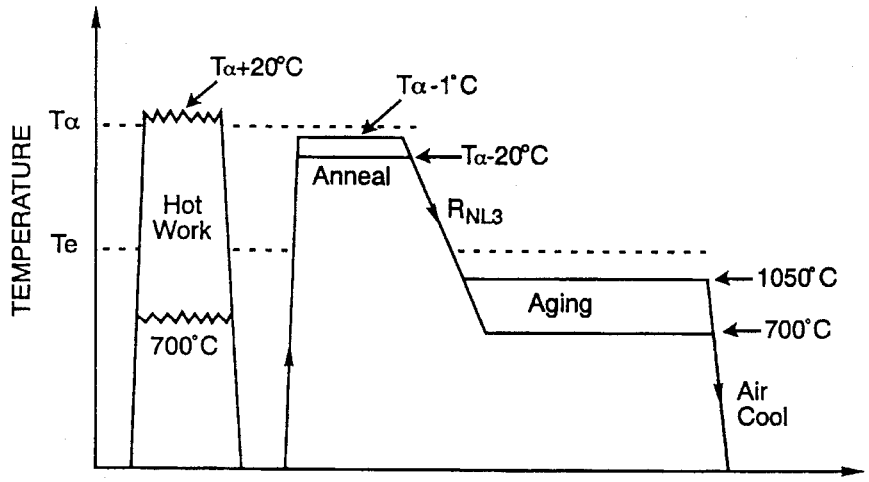

The method to produce nearly-lamellar (NL) microstructures are essentially the same as those for duplex microstructures, except for the annealing temperatures and conditions, as shown in FIGS. 3 and 4. Referring to FIG. 3, nearly-lamellar microstructures are obtained by way of indirect aging by first annealing at a temperature in the range of $T_\alpha$–1 ° C. to $T_\alpha$–20° C. for about 0.5 to 10 hours, cooling at rate $R_{NL1}$ to $T_c$, then cooling at rate $R_{NL2}$ to room temperature. The article is then given an aging treatment at a temperature in the range of 700° to 1050° C. for about 2 to 150 hours, depending on the final microstructure, desired mechanical properties and desired microstructural stability, followed by air cooling. For nearly-lamellar processing, the cooling rate $R_{NL1}$ ranges from 5° to 1000° C./min, which includes air cooling (AC). Cooling rate $R_{NL2}$ ranges from $R_{NL1}$ to water quenching (WQ), including oil quenching (OQ). Cooling rates faster than air cooling (AC) can be used only when the article is not cracked during cooling. $T_c$ is the temperature at which the cooling rate is increased so that coarsening of the second phase(s) is reduced or suppressed.

Referring now to FIG. 4, scheme II nearly-lamellar processing employs an annealing treatment followed by cooling at rate $R_{NL3}$ directly to the aging temperature (700° C. to 1050° C.). Cooling rate $R_{NL3}$ is the same as rate $R_{NL1}$, ranging from 5° to 1000° C./min, which can be achieved either by controlled cooling in the furnace or by transferring the article to another furnace or a salt bath at aging temperature.

Figure 5:
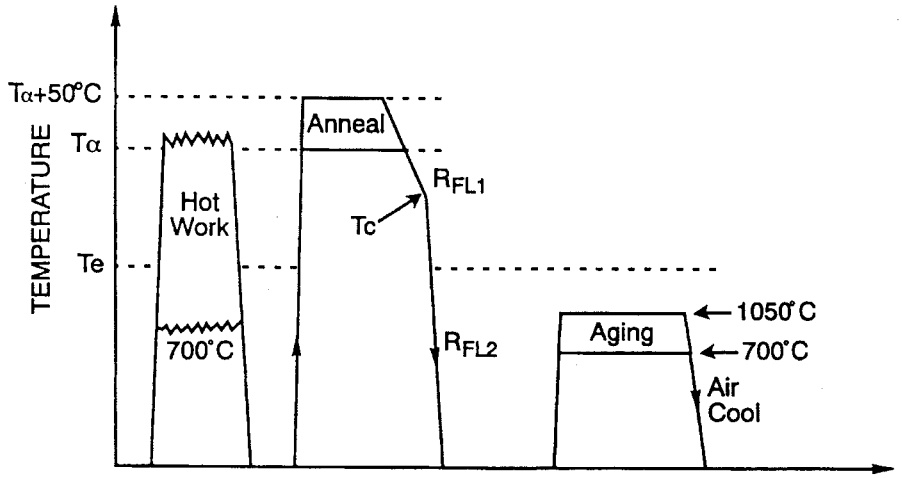
FIGS. 5 and 6 are schematic illustrations of methods for obtaining fully lamellar microstructure.
Figure 6:
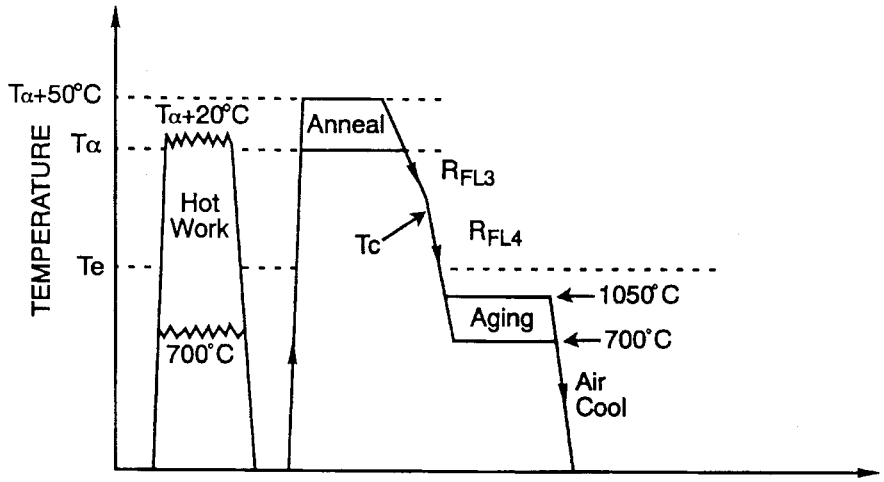

The processing for producing fully lamellar microstructures consists of hot working, annealing and either indirect aging, as shown in FIG. 5, or direct aging, as shown in FIG. 6. Post-hot work annealing is conducted at a temperature in the range of $T_\alpha$to $T_\alpha$+50° C. for about 2 minutes to 5 hours, depending on alloy composition, material section size, annealing temperature, desired distribution of microstructural constituents and grain mophology and size. The articles may be heated to the annealing temperature directly or, optionally, to a preanneal temperature between about $T_\alpha$–1° C. and $T_\alpha$–20° C. for about 10 minutes to 5 hours.

Cooling rates and methods are critical for desired microstructures and the resulting mechanical properties. As shown in FIG. 5, two cooling rates $R_{FL1}$ and $R_{FL2}$ are employed. Rate $R_{FL1}$ is used for the initial cooling from the annealing temperature ($T_a$) down to a preselected temperature $T_c$. The initial cooling rate, $R_{FL1}$ ranges from 5° to 100° C./min. Higher cooling rates may result in disturbed lamellar microstructures, such as Widmanstätten, and massively transformed gamma microstructures in many compositions, depending on the level of aluminum. The maximum cooling rate for perfect lamellar structures is a function of annealing temperature and grain size, with the rates being higher for finer grain sizes for a given alloy. The $T_c$ ranges from $T_L$ to 800° C., where $T_L$ is the temperature at which the formation of lamellar structures during cooling is completed. $T_L$ decreases with increasing $R_{FL1}$, being a temperature about 1200° C. for $R_{FL1}$ of about 60° C./min. Increases of $R_{FL1}$ result in the formation of finer or thinner lamallae. During cooling below $T_L$ the lamellar spacing coarsens thermally. Cooling rate $R_{FL2}$ ranges from $R_{FL1}$ to water quenching (WQ), including oil quenching (OQ). Cooling rates faster than air cooling (AC) can be used only when the article is not cracked during cooling. The article is then given an aging treatment at a temperature in the range of 700° to 1050° C. for about 2 to 150 hours, depending on the final microstructure, desired mechanical properties and desired microstructural stability, followed by air cooling.

Referring now to FIG. 6, scheme II fully lamellar processing employs an annealing treatment followed by cooling at rates $R_{FL3}$ and $R_{FL4}$ to the aging temperature (700° C. to 1050° C.). Cooling rate $R_{FL3}$ is the same as rate $R_{FL1}$, raging from 5° to 100° C./min, which can be achieved either by controlled cooling in the furnace or by transferring the article to another furnace or a salt bath at aging temperature. Cooling rate $R_{FL4}$ is the same as rate $R_{FL2}$.

Thus, to obtain lamellar spacing ($\lambda_L$) as fine as possible, it is necessary to employ the maximum $R_{FL1}$ rate and to suppress coarsening by then cooling the sample at the maximum $R_{FL2}$ rate. To obtain coarser lamellar spacings, either the cooling rates are decreased and/or $T_c$ is lowered.

The following examples illustrate the invention. In the runs which follow, the alloy K5 has the nominal composition: Ti—46.5A1–2Cr—3Nb—0.2W. $T_\alpha$ for this alloy was determined to be 1320° C. Billets cut from ingots prepared by skull melting/casting, followed by HIP'ing at 1260° C. under a pressure of 200 MPa, were isothermally forged at 1150° C. (2-step, 91% reduction). The microstructures shown in Tables I–III, below, were obtained by the methods given previously. Tensile, fracture toughness and fatigue tests were conducted at room and elevated temperatures. All tensile testing was conducted in air.

TABLE I

Tensile Properties and Fracture Toughness of Alloy K5

| Microstructure | Test Temperature (°C.) | UTS (MPa) | 0.2% YS (MPa) | EL (%) | Toughness (MPa√m) |
|---|---|---|---|---|---|
| Duplex | RT | 580 | 462 | 2.9 | 11.0 |
| Duplex | 600 | 534 | 398 | 3.4 | |
| Duplex | 800 | 350 | 317 | 30–150 | |
| Nearly Lamellar | RT | 652 | 536 | 1.8 | |
| Nearly Lamellar | 600 | 644 | 461 | 2.7 | |
| Nearly Lamellar | 800 | 596 | 423 | 80 | |
| Fully Lamellar | RT | 540 | 472 | 1.2 | 20–22 |
| Fully Lamellar | 600 | 514 | 405 | 1.8 | |
| Fully Lamellar | 800 | 508 | 382 | 3.4 | |
| Fully Lamellar | 900 | 420 | 330 | 36 | |

TABLE II

High Cycle Fatigue Properties

| Microstructure | Test Temperature (°C.) | FS* (MPa) | FS/YS | FS/UTS |
|---|---|---|---|---|
| Duplex | 600 | 525 | 1.25 | 0.95 |
| Duplex | 800 | 250 | 0.60 | 0.48 |
| Fully Lamellar | 600 | 470 | 1.15 | 0.94 |
| Fully Lamellar | 800 | 310 | 0.82 | 0.66 |
| Fully Lamellar | 870 | 260 | 0.72 | 0.54 |

*Fatigue Strength at $10^7$ cycles runout.

TABLE III

Creep Properties

| Microstructure | Test Temperature (°C.) | Stress (MPa) | Time to 0.2% (hr) | Time to 1.0% (hr) | Min. Creep Rate (per hr) |
|---|---|---|---|---|---|
| Duplex | 800 | 70 | 15.6 | 8 | $0.92 \times 10^{-5}$ |
| Duplex | 800 | 173 | 0.035 | 2.0 | $0.46 \times 10^{-3}$ |
| Fully Lamellar | 760 | 138 | 45.5 | 421.0** | $6.4 \times 10^{-6}$ |
| Fully Lamellar | 800 | 138 | 6.0 | 157.5 | $3.8 \times 10^{-5}$ |
| Fully Lamellar | 800 | 173 | 1.0 | 60.1 | $1.0 \times 10^{-4}$ |
| Fully Lamellar | 870 | 103 | 2.4 | 50.4 | $1.2 \times 10^{-4}$ |
| Fully Lamellar | 870 | 138 | 0.7 | 3.4 | $6.3 \times 10^{-4}$ |

**421.0 hours to 0.5% total strain.

Various modifications may be made to the invention as described without departing from the spirit of the invention or the scope of the appended claims.

We claim:

1. A method to produce duplex microstructure in an article of tungsten-containing gamma titanium aluminide alloy, which comprises the steps of (a) hot working the article, (b) annealing the so hot worked article at an annealing temperature in the range of $T_e$+100° C. to $T_\alpha$–30° C. for about 1 to 15 hours, (c) cooling said article from said annealing temperature to a preselected temperature between said annealing temperature and about 700° C. at a first cooling rate of about 5° to 1000° C./min, (d) increasing the cooling rate to a second rate ranging from said first cooling rate to water quenching, and cooling said article from said preselected temperature to room temperature, and (e) aging the so cooled article at an aging temperature in the range of 700° to 1050° C. for about 2 to 150 hours.

2. The method of claim 1 wherein said alloy has the composition Ti—(45.5–47.5)Al—(0–3.0)X—(1–5)Y—(0.05–1.0)W, where X is Cr, Mn or any combination thereof, and Y is Nb, Ta or any combination thereof.

3. The method of claim 2 wherein said alloy has the composition Ti—(46–47)Al—(1.5–3.0)Cr—(2–3.5)Nb—(0.1–0.3)W.

* * * * *

UNITED STATES PATENT AND TRADEMARK OFFICE

CERTIFICATE OF CORRECTION

PATENT NO. : 5,558,729

DATED : September 24, 1996

INVENTOR(S) : Young-Won Kim et al

It is certified that error appears in the above-indentified patent and that said Letters Patent is hereby corrected as shown below:

Column 3, line 53, "mounts" should read --- amounts ---.

Column 5, line 7, "$T_\alpha 30°$" should read --- $T_\alpha$-30° ---.

Column 6, line 57, "raging" should read --- ranging ---.

Signed and Sealed this

Twenty-first Day of January, 1997

*Attest:*

*Attesting Officer*

BRUCE LEHMAN

*Commissioner of Patents and Trademarks*